US005875832A

United States Patent [19]

Senser et al.

[11] Patent Number: 5,875,832

[45] Date of Patent: Mar. 2, 1999

[54] METHOD AND APPARATUS FOR CONTINUOUS CASTING USING A ROTATING CYLINDER

[75] Inventors: Steven H. Senser, Lexington, Ohio; Dale L. Haberny, 18600 Haskins Rd., Chagrin Falls, Ohio 44023

[73] Assignee: Dale L. Haberny, Chagrin Falls, Ohio

[21] Appl. No.: 604,279

[22] Filed: Feb. 21, 1996

[51] Int. Cl.[6] ..... B22D 5/04; B22D 39/00

[52] U.S. Cl. ..... 164/457; 164/66.1; 164/129; 164/135; 164/259; 164/155.5; 164/324; 164/329; 164/335

[58] Field of Search ..... 164/135, 133, 164/129, 130, 335, 457, 66.1, 259, 324, 329, 155.5; 222/604, 591

[56] References Cited

U.S. PATENT DOCUMENTS

| | | | |
|---|---|---|---|
| 883,253 | 3/1908 | Steese . | |
| 1,319,673 | 10/1919 | Stephenson . | |
| 1,354,975 | 10/1920 | Hurst et al. . | |
| 1,435,007 | 11/1922 | Hurst . | |
| 2,151,683 | 3/1939 | Busche . | |
| 2,167,883 | 8/1939 | Ferree . | |
| 2,199,598 | 5/1940 | Robbins . | |
| 2,227,872 | 1/1941 | Willard . | |
| 2,439,875 | 4/1948 | Steudel . | |
| 2,676,368 | 4/1954 | Heiden et al. . | |
| 2,743,491 | 5/1956 | Berry . | |
| 2,763,904 | 9/1956 | Sukava . | |
| 2,775,802 | 1/1957 | Boughton . | |
| 2,806,264 | 9/1957 | Keating . | |
| 2,891,292 | 6/1959 | Sukava . | |
| 2,943,369 | 7/1960 | Szwed . | |
| 3,015,137 | 1/1962 | Hoebing . | |
| 3,052,934 | 9/1962 | Kerber . | |
| 3,122,800 | 3/1964 | Naffziger . | |
| 3,188,704 | 6/1965 | Sukava . | |
| 3,259,485 | 7/1966 | Kootz et al. . | |
| 3,319,728 | 5/1967 | Johansson et al. . | |
| 3,343,591 | 9/1967 | Lorang . | |
| 3,429,362 | 2/1969 | Tachimoto et al. . | |
| 3,512,575 | 5/1970 | Bowden et al. . | |
| 3,627,019 | 12/1971 | Hitchcock et al. . | |
| 3,815,659 | 6/1974 | Pavlo et al. | 164/133 X |
| 4,050,961 | 9/1977 | Knight | 164/135 X |
| 4,576,220 | 3/1986 | Smyth et al. | 164/130 X |
| 4,678,168 | 7/1987 | Enkner et al. | 222/604 X |
| 4,911,222 | 3/1990 | Alfaro | 164/335 X |

FOREIGN PATENT DOCUMENTS

| | | | |
|---|---|---|---|
| 55-16768 | 2/1980 | Japan | 164/335 |
| 1-262063 | 10/1989 | Japan | 222/604 |
| 5-169192 | 7/1993 | Japan | 164/133 |
| 1708498 | 1/1992 | U.S.S.R. | 164/133 |
| 126873 | 5/1919 | United Kingdom | 222/604 |

*Primary Examiner*—J. Reed Batten, Jr.
*Attorney, Agent, or Firm*—Renner, Otto, Boisselle & Sklar

[57] ABSTRACT

The apparatus includes a cylinder for holding molten material and a plurality of molds each having a plurality of cavities for receiving molten material. As the cylinder is rotated by a driving mechanism, the molten material is passed through a plurality of holes in a cylindrical wall which surrounds the holding area where the molten material is located, and into the cavities in the molds, which are transported in series beneath the cylinder as the cylinder rotates.

24 Claims, 3 Drawing Sheets

METHOD AND APPARATUS FOR CONTINUOUS CASTING USING A ROTATING CYLINDER

TECHNICAL FIELD

The present invention relates generally, as is indicated, to a system for continuously casting pieces using a rotating cylinder. In a particular embodiment, the present invention relates to a system for casting uniform shapes of aluminum known as nuggets.

BACKGROUND OF THE INVENTION

Aluminum nuggets are used in the steel making industry as a deoxidizing agent and to remove impurities. As is known, basic oxygen furnaces or electric arc furnaces are used to produce steel by removing the carbon content of the molten iron using oxygen lance. Iron oxide fumes are produced causing a weight loss in the steel produced and a waste disposal problem. When aluminum is added during the steel making, such as in the form of nuggets, it reacts with the iron oxide fumes to form an exothermic reaction generating large quantities of heat and deoxidizes the iron oxide fumes into molten iron while the aluminum is oxidized into aluminum oxide.

The forming of a molten aluminum layer over the iron and slag surface is important to maximize the reaction and obtain a higher yield. The aluminum layer floats on the top of the molten steel and blocks communication between the top of the molten steel and ambient air to tend to prevent undesired oxidation of the steel. Thus, aluminum bodies of relatively uniform weights and shapes (herein referred to as nuggets) are used for easy handling and to provide a relatively controlled amount of or generally uniform dispersion of molten aluminum needed during steel production.

A number of conventional machines have been used to produce aluminum shapes (nuggets) using a pouring mechanism that tilts a ladle by mechanical or hydraulic means to fill multiple cavities in each mold. Once the cavities are filled, the mechanism retracts to a non-pouring position and prepares to pour into the next mold. Another conventional approach has been to pour aluminum into cavities of special design molds using a tundish with bottom pouring orifices. Unfortunately, these mechanisms and the special configurations of the molds have impeded the capability to produce large quantities of aluminum shapes at reduced costs.

As an example, U.S. Pat. No. 3,512,575 discloses a method and apparatus by which the aluminum shapes are produced by using a ladle tilting mechanism to fill the mold cavities and which retracts after the cavities are filled. These motions are repeated with every mold that passes underneath the filling mechanism.

U.S. Pat. No. 3,964,542 discloses a method and apparatus by which the aluminum shapes are produced by pouring molten aluminum into cavities and using a tundish with bottom orifices. The molds are specially arranged to prevent metal from bridging over from cavity to cavity.

U.S. Pat. No. 2,199,598 discloses a method and apparatus by which the molds are filled using a supply pipe for liquid metals to a pouring wheel with a discharge orifice. Each orifice is advanced by the successive molds as the molds are advanced beyond the pouring station.

In view of the aforementioned shortcomings associated with conventional systems, there is a strong need in the art for a system for producing aluminum shapes having uniform weight and shape at a high production volume and at a reduced cost. Moreover, there is a strong need in the art for a system which prevents splashing of molten aluminum or bridging of metal between mold cavities.

SUMMARY OF THE INVENTION

The present invention relates to a method and apparatus for producing uniform shapes of aluminum known as aluminum nuggets. Although the invention is described primarily in the context of making aluminum nuggets, it will be appreciated that the invention has application regardless of the type of material to be cast or molded. In the exemplary embodiment, the present invention pours molten aluminum into cavities of a mold; the exemplary cavities are a truncated pyramid or a truncated cone shape. Molds are made of cast iron, each containing twin rows of cavities which are laterally spaced apart on a rotating chain conveyor to form a line equipped with a variable speed drive mechanism. The line allows for the pouring of molten aluminum, cooling and removal of the nuggets. The molds pass underneath a rotating cylinder that contains molten aluminum supplied from a smelting furnace or a holding vessel either by gravity or by a special high temperature variable speed pump made out of graphite. The rotating cylinder is equipped with rows of pouring holes coordinated to the cavities in the mold, for example being equal in number to the number of cavities in the mold section beneath. The holes on the circumference of the cylinder are located in rows with each row located to match the exact pouring position into each row of cavities in each mold. The size of the pouring holes is selected to allow for free flow of the molten aluminum into the mold cavities underneath.

The rotation of the cylinder is synchronized with the conveyor line speed to precisely position the pouring holes over the mold cavities. The flow of molten aluminum from the smelting furnace to the rotating cylinder is controlled by the size of the tap hole or by changing the pump speed. A plurality of natural gas burners are located near the rotating cylinder to keep the cylinder body at elevated temperature to maintain the molten aluminum flowing into the pouring holes and to maintain a non-oxidizing atmosphere within the cylinder.

The rate of production of aluminum shapes made by this invention is controlled by the rate of transfer of molten aluminum to the rotating cylinder and the speed of the casting line. Thus, production can be adjusted at any time and the weight of aluminum shapes can be controlled. As a result of the present invention, production can be increased by up to a factor of ten over other methods, where the pouring process is intermittent or limited by a special mold configuration.

According to one aspect of the present invention, an apparatus for continuous casting of molded items includes: a cylinder having a generally cylindrical wall, which may be circular or other shape, surrounding a holding area therein, the cylindrical wall including a plurality of holes through which a material in the holding area can flow out of the cylinder; a plurality of cavities which are transported in series beneath the cylinder as the cylinder rotates; and wherein as the plurality of cavities pass by the rotating cylinder the material in the holding area pours into each of the plurality of cavities from a respective one of the plurality of holes.

According to another aspect of the invention, an apparatus for continuous casting of metal shapes includes: a rotating cylinder synchronized with a speed of a conveyor line passing beneath the cylinder, the cylinder having a cylinder wall with a plurality of pouring holes therein and the pouring holes being arranged in rows around the circumference of the cylinder; and a plurality of molds on the conveyor line, each mold having at least one row of cavities corresponding in number to the number of pouring holes in a row on the cylinder; wherein material within the cylinder pours through the pouring holes at the bottom of the cylinder into the cavities as the cavities pass beneath the cylinder.

According to yet another aspect of the invention, a method for continuously casting molded items includes the steps of: rotating a cylinder having a generally cylindrical wall surrounding a holding area therein, the cylindrical wall including a plurality of holes through which a material in the holding area can flow out of the cylinder; and transporting a plurality of cavities in series beneath the cylinder as the cylinder rotates such that as the plurality of cavities pass by the rotating cylinder the material in the holding area pours into each of the plurality of cavities from respective holes.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF THE PREFERRED EMBODIMENT

Figure 1:
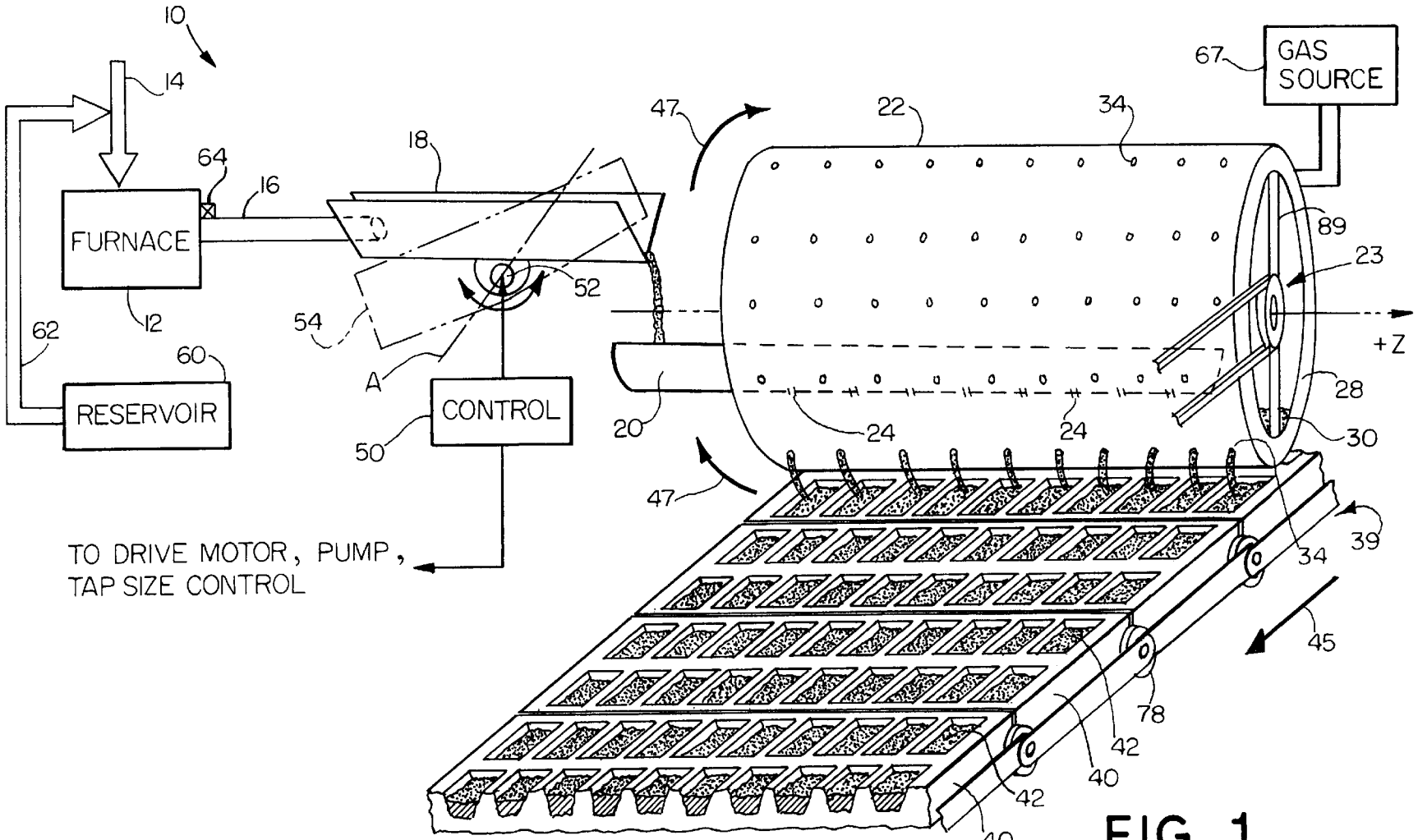
FIG. 1 is a system view of an apparatus for continuous casting of molded nuggets in accordance with the present invention.

The apparatus and method of the present invention will now be described with reference to the drawings wherein like reference numerals are used to refer to like elements throughout.

Referring initially to FIG. 1, a continuous casting-type system for producing uniform shapes (nuggets) of aluminum or another material is generally designated 10. Although the system will be described herein primarily in the context of producing aluminum nuggets, it will readily be apparent to those having ordinary skill in the art that the invention has application for any number of different materials and is not limited to the production of aluminum nuggets. The nuggets preferably are of conical or pyramid shape; they may be truncated; and this shape facilitates immersion into a molten steel bath and rapid melting of the nuggets therein. The shape also facilitates removing the nuggets from molds described below.

The system 10 includes a furnace 12 for melting aluminum stock provided thereto as represented by arrow 14. The furnace 12 can be a smelting furnace or any other type of furnace or device for melting or otherwise serving as a source of molten aluminum.

The molten aluminum provided from the furnace 12 flows through a conduit 16 to a trough 18. The trough 18 as shown in FIG. 1 is oriented with the end on the left being slightly higher in elevation than the other end of the trough 18. The molten aluminum enters the trough 18 at the left end and flows as a result of gravity towards the right end. Consequently, the molten aluminum flows from the right end of the trough 18 down into a receiving trough 20 which extends into an open end of a rotating cylinder 22. The cylinder 22 rotates about its z-axis by way of a driving mechanism such as a chain and sprocket assembly 23. The receiving trough 20 runs generally parallel with the z-axis and is also slightly inclined such that molten aluminum from the trough 18 flows towards the interior of the cylinder 22. The bottom of the receiving trough 20 includes a plurality of holes 24 spaced along the major axis of the trough 20 which allows the molten aluminum therein to flow freely out of the trough 20 into the bottom of the cylinder 22.

The cylinder 22 has a small retaining wall 28 along the peripheral edge of each end of the otherwise generally hollow cylinder. The walls 28 enable the cylinder 22 to retain a small pool 30 of molten aluminum at the bottom of the cylinder 22. The molten aluminum within the pool 30 freely flows out of the cylinder 22 through rows of holes 34 in the wall of the cylinder 22. Each row of holes runs the length of the cylinder 22, with the cylinder including a plurality of rows equally spaced about the circumference of the cylinder wall. As the cylinder rotates, a different row of holes 34 will pass along the bottom of the cylinder. During the time that a row of holes is beneath the fluid level of the pool 30 the molten aluminum within the pool will tend to pour through the holes 34. At the same time, carried beneath the holes 34 on a conveyor line 39 (see, e.g., FIG. 2) is a series of molds 40. Each mold 40 includes a plurality of cavities 42 into which molten aluminum from a respective one of the holes 34 is poured as will be explained in more detail below. The speed and direction of the mold conveyor (as represented by arrow 45) is coordinated or synchronized with the speed and direction of rotation of the cylinder 22 (as represented by arrows 47).

After the molten aluminum has been poured into the respective cavities 42, the molds proceed along the conveyor line through air and water cooling stations (not shown) which cool the nuggets formed within the cavities. Thereafter, the molds proceed along the conveyor line to a removal station (not shown) where the nuggets are removed from the molds by way of an impact hammer or the like which jars the nuggets loose so as to fall within a transfer bin.

In accordance with the exemplary embodiment, the trough 18 is designed to pivot about an axis A by way of a controller 50 designed to control a motor 52. In order to regulate when molten aluminum is delivered to the pool 30, the system 10 controllably rotates the trough 18 between the position shown in FIG. 1 (in solid line) and the counter-clockwise rotated position 54 represented in phantom in FIG. 1. When the trough 18 is in the position shown in phantom, the rightmost end is elevated higher than the leftmost end. As a result, molten aluminum from the conduit 16 flows into the trough 18 and is subsequently poured into a reservoir 60 rather than being delivered to the cylinder 22. Molten aluminum from the reservoir 60 is subsequently pumped back to the furnace 12 (as represented by arrow 62) where the aluminum is reheated. When the trough 18 is in the position shown in solid line, molten aluminum will be delivered to the cylinder. Thus, by controlling the position of the trough 18, the controller 50 is able to provide selectively a continuous flow of molten aluminum to the cylinder. Control also may be provided manually. During production, the trough 18 is placed in the position shown in FIG. 1 (solid line). During a pause in production, for example, the trough 18 is placed in the position shown in phantom in FIG. 1 so that the molten material will stop flowing to the cylinder 22 but may continue in a flow path via the trough 18 and reservoir 60 to scrap or back into the furnace. Also, during a start up or some condition when the purity, completeness of melt, etc. of the aluminum is unsatisfactory for pouring into mold cavities 42, or when the cylinder or molds are not ready to receive molten aluminum, the trough 18 can be tilted to the position 54 to direct flow to the reservoir 60 and/or furnace 12.

The flow rate of the molten aluminum to the cylinder 22 can be controlled by altering the tap size, e.g., the opening of a tap valve 64, for gravity flow from the furnace 12, or by adjusting the pump speed when using a pump to pump molten aluminum from the furnace 12 to the cylinder. The level of the pool 30 within the cylinder 22 is determined by the flow rate of the molten material to the cylinder 22 and the rate of flow from the cylinder. The appropriate flow rate of the molten material to the cylinder can be determined empirically as will be appreciated. The controller 50 is designed to be able to control the tap size via an adjustable valve or the like and/or pump speed for adjusting the rate of flow of the molten material. The controller 50 is also connected to a primary driver within the system (not shown) such as a motor for driving the chain and sprocket assembly 23 for rotating the cylinder 22 and for moving the molds along the conveyor line. By adjusting the rate of rotation of the cylinder and the conveyor rate together with the flow rate of molten aluminum to the cylinder, the rate of production of the nuggets is controlled.

The controller 50 is designed to provide the appropriate control signals to the motor 52 and the primary motor based on user requested production requirements. Such information can be input into the controller 50 via an input keyboard (not shown). It will be appreciated that in another embodiment, molten aluminum can be provided directly to the cylinder 22 from the furnace 12 by way of a pump. In such case, the flow rate of molten aluminum can be controlled by adjusting the pump speed as previously mentioned.

The system 10 further includes a plurality of gas burners (FIG. 3) which are located adjacent the cylinder 22 for developing a flame which enshrouds the cylinder. As discussed in more detail in connection with FIGS. 3 and 5, such flame keeps the cylinder at an elevated temperature for maintaining the molten aluminum within the holes 34 and to maintain a non-oxidizing atmosphere within the cylinder. A source of combustible gas 67 supplies gas to the burners.

Figure 2:
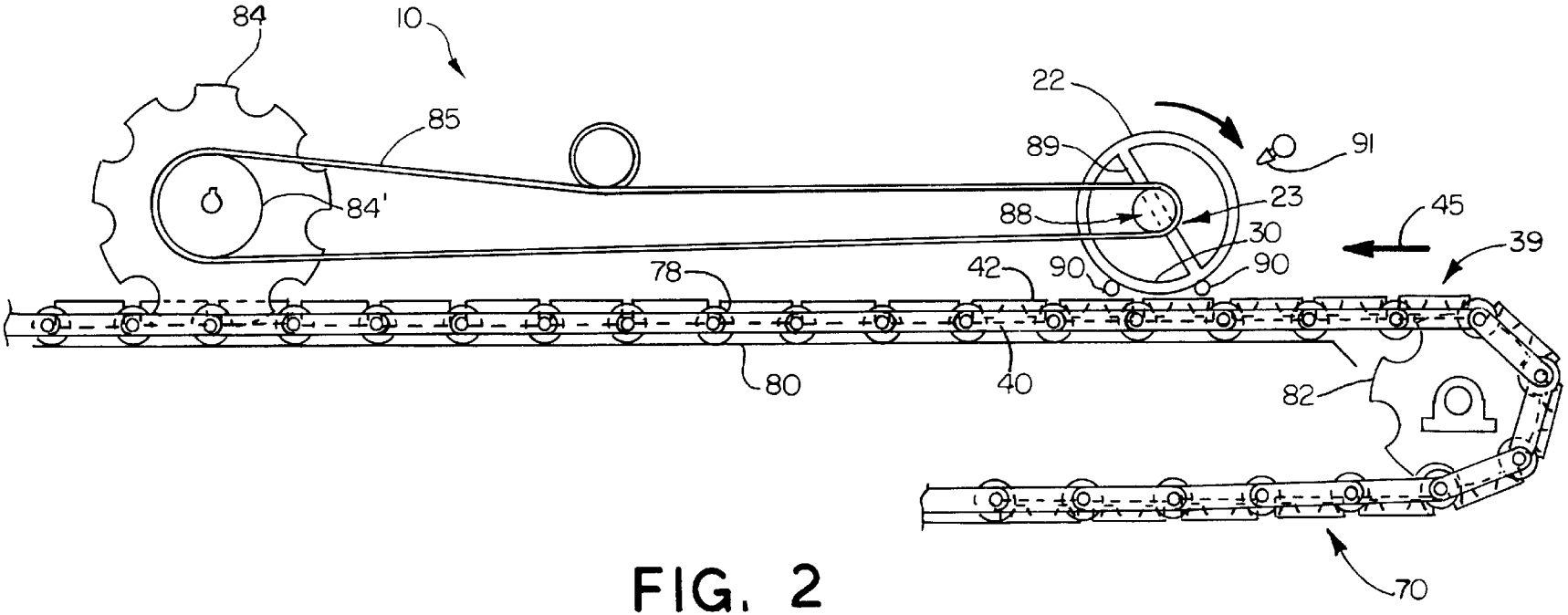
FIG. 2 is a side view of the pouring and mold conveying apparatus of FIG. 1 in accordance with the present invention.

Turning now to FIG. 2, a partial side view of the system 10 is shown. In the exemplary embodiment, the molds 40 are placed in laterally spaced-apart relation on an endless chain conveyor 70 to form a conveyor line 39 with a variable speed drive. The conveyor 70 includes rollers 78 for supporting the molds on a support frame 80. One or more sprockets 82 serve to guide the rollers 78 and chain in a conventional manner. A main sprocket 84 driven by the primary motor (not shown) engages the chain conveyor in order to drive the conveyor line in the direction shown by arrow 45. The main sprocket 84 includes a secondary sprocket 84' concentrically affixed thereto. The sprocket 84' engages the chain 85 of the chain and sprocket assembly 23 such that the cylinder 22 is also driven by the primary motor. The sprocket ratios of the respective sprockets are selected such that the speed of the molds on the conveyor line 70 is synchronized with the speed of rotation of the cylinder 22. In addition, the rotational position of the cylinder is such that a hole 34 at the bottom of the cylinder is always aligned with a respective cavity of a mold passing therebeneath.

Figure 3:
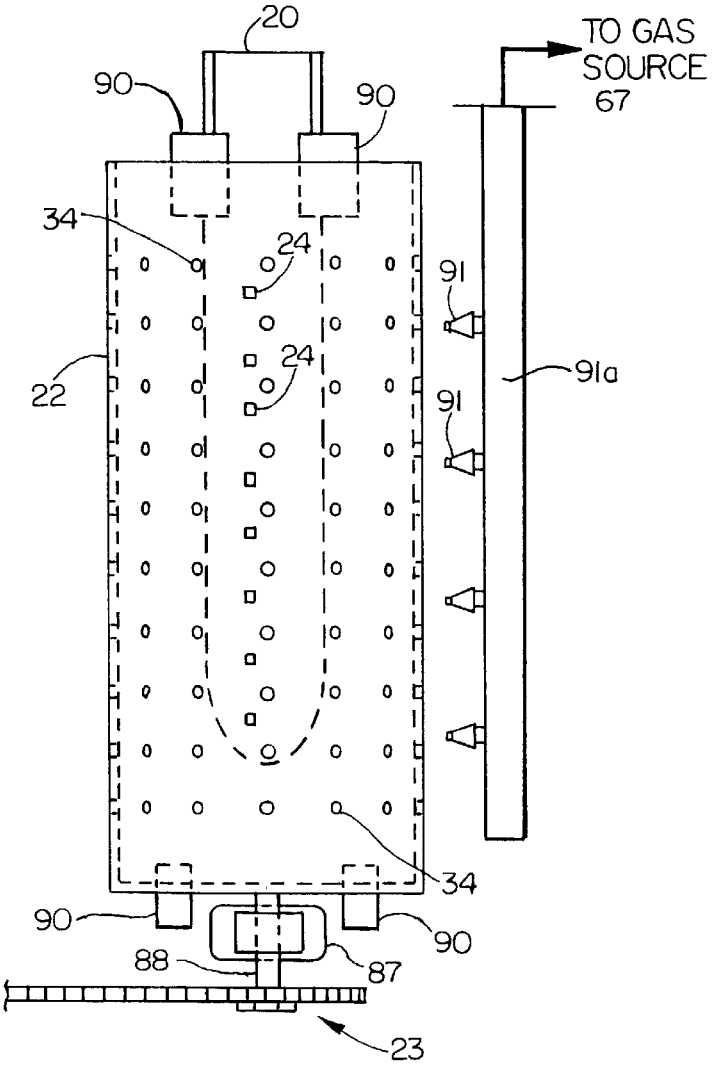
FIG. 3 is a view of the rotating cylinder and gas burners in accordance with the present invention.

Referring briefly to FIG. 3, the details of the cylinder 22 will now be explained. The cylinder 22 can be made of any material, such as cast iron, capable of withstanding the harsh environment associated with aluminum casting. The cylinder wall has a thickness on the order of 0.438 inches. The holes 34 in the cylinder wall are arranged in a number of rows running the length of the cylinder. Each row includes holes 34 equal in number to the number of cavities 42 in a row in the mold 40 directly underneath. The holes 34 in each row are located as mentioned above so as to be in alignment with the respective cavities in each corresponding row in order to be in an aligned pouring position. The size of the holes 34 are on the order of 0.500 inches in diameter, or whatever size is appropriate to allow for free flow of the molten material into the mold cavities underneath.

The cylinder 22 is supported in journaled relationship at one end by a support member 87 in a pillow block arrangement, for example, as represented in FIG. 3. A shaft 88 connected to a support bar 89 (FIG. 2) both supports the cylinder 22 from the support member 87 and rotates the cylinder about its longitudinal axis. The outside of the cylinder 22 also rests against four roll supports, two near each end of the cylinder, which further support the cylinder and permit rotation thereof. Alternatively, the rolls 90 may provide the support for the cylinder 22, and the shaft 88 may primarily or solely provide rotational force. The other end of the cylinder opposite shaft 88 and support bar 89 is preferably unsupported other than by support rolls 90 to allow for convenient access of the trough 20 to the interior of the cylinder. It will be appreciated that the cylinder 22 is supported by a set of support rolls 90 at the ends of the cylinder 22 upon which the cylinder 22 rides while being rotated by the chain and sprocket 23 driving mechanism operating via shaft 88.

Figure 4:
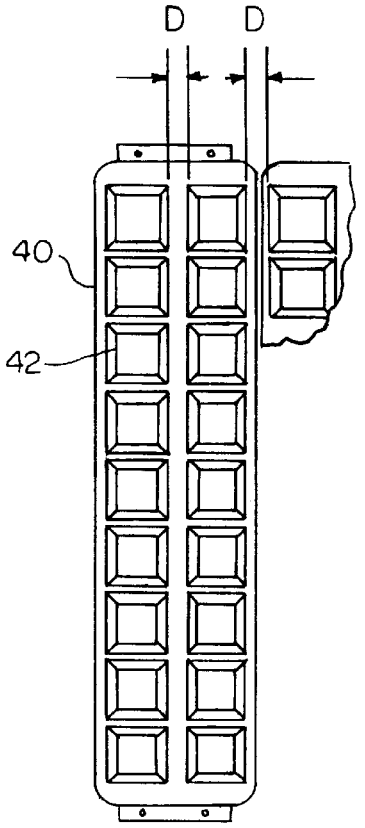
FIG. 4 is a top view of a mold in accordance with the present invention.

FIG. 4 represents an exemplary mold 40 having cavities 42 in accordance with the present invention. The molds 40 may be made of cast iron or the like. In the exemplary embodiment, each cavity consists of a truncated pyramid or truncated cone shape which results in the casting of nuggets having such shape. It will be appreciated, however, that other shapes could be used without departing from the scope of the invention. Each mold 40 includes two rows of cavities 42. There are ten cavities in each row so as to correspond with the number of holes 34 in each row of the cylinder 22. The divider space D between the cavities in each row of the mold 40 is equal to the space D between adjacent mold cavities of adjacent molds 40, such that all cavities in the direction of travel of the conveyor line are equally spaced by a distance D. The rows of holes 34 are equally spaced about the circumference of the cylinder 22 with each row located to match the exact pouring position in each row of cavities (i.e., the rows are spaced an effective distance D apart).

Thus, during the rotation of the cylinder 22, the position of the bottom row of the pouring holes 34 is always inline with a corresponding row of cavities during its lateral travel and, more specifically, inline with the center of the corresponding cavities 40. Because of the precise positioning of the holes 34, bridging of metal from cavity to cavity is eliminated and there is no splashing of metal between molds.

Referring back to FIG. 3, the rotating cylinder 22 includes twelve rows of holes 34 with each row including ten holes 34. When the cylinder 22 makes one revolution, six molds 40 pass underneath. As a result, the system casts one hundred and twenty nuggets with each rotation. The rate of production of the nuggets and the weight of each nugget are controlled by changing the size of the tap hole which provides the molten aluminum from the furnace 12 or the speed of a pump which pumps the material to the cylinder, and by changing the speed of the conveyor line. Thus, production can be adjusted at any time and the weight of the aluminum shapes can be controlled. Moreover, because of the conveniences of the present invention the production rate of aluminum nuggets can be increased on the order of up to ten times over that of conventional production methods where the pouring process is intermittent or limited by special mold configurations. Due to the precise positioning of the pouring holes over the mold cavities and the convenient controls of the invention, waste and scrap resulting from misformed shapes, bridging and splashing of molten aluminum between cavities have been eliminated. Also, the invention can provide efficient, continuous operation and manufacturing of the nuggets by beginning to pour material into a mold cavity 42 as soon as it is properly aligned with a respective hole 34.

Figure 5:
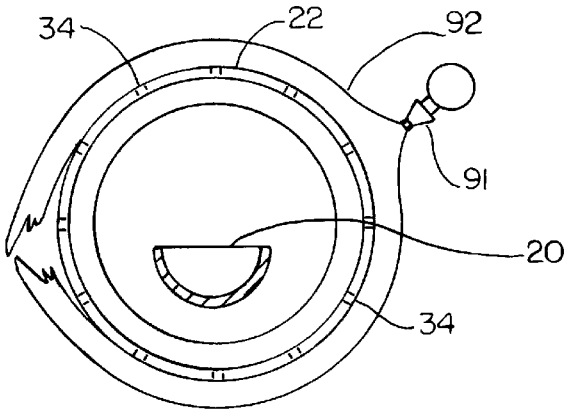
FIG. 5 is a cross-sectional side view of the rotating cylinder and gas burners of FIG. 3 in accordance with the present invention.

Referring again to FIG. 3 and to FIG. 5, a plurality of inspirator type gas burners 91 located in a gas line or pipe 91*a* parallel the surface of the cylinder wall are supplied with a combustible gas from the source 67 and burn the gas to produce a gas flame 92. The gas flame 92 formed by the burners 91 produces a shroud which tends to envelop the outer surface of the cylinder 22. The flame 92 serves to keep the cylinder 22 at an elevated temperature to ensure that the molten aluminum continues flowing into and through the holes 34. In addition, the flame helps prevent wetting of the cylinder walls and preferably consumes all oxygen in the area inside the cylinder, immediately outside the cylinder and in the area of the mold being filled from the cylinder. The flame maintains a non-oxidizing atmosphere within and immediately outside the rotating cylinder to prevent oxidation of the aluminum; if the aluminum would oxidize, it would tend to plug the holes 34. Thus, the flame 92 is useful in ensuring that the system continues to produce nuggets even over extended periods of time. Also, although only a single line of burners 91 is shown in the exemplary embodiment, it will be appreciated that additional burners could be located about the cylinder to assist in forming the desired shroud of flame. If desired an inert gas may be used to envelop the cylinder 22 to provide an inert (non-oxidizing) environment for the cylinder 22 and molten material therein.

It can be seen in FIG. 3 that the trough 20 within the cylinder 22 includes holes 24 through which the molten aluminum flows into the pool 30 at the bottom of the cylinder. In order to provide more uniform flow within the system 10, the holes 24 are purposely laterally offset in the z-axis direction relative to the holes 34 in the cylinder wall. This ensures that there will not be direct flow of molten aluminum between the holes 24 and the holes 34. Furthermore, in the preferred embodiment the holes 24 gradually increase in diameter in a direction travelling from the end of the cylinder 22 at which the trough 20 enters the cylinder to the end including the chain and sprocket assembly 23. As a result, a more even distribution of molten aluminum between the trough 20 and the cylinder 22 can occur along the z-axis.

It will be appreciated that the rotational speed of the cylinder 22 and linear speed of the conveyor line 39 not only are coordinated but also can be changed.

By increasing speed the amount of aluminum poured into each mold cavity is reduced and smaller nuggets are obtained. Conversely, slowing speed increases the quantity of poured aluminum into each cavity and the nugget size. Such speed control can be obtained by the controller 50, for example.

It also will be appreciated that the amount of material flowing into each mold cavity 42 and, thus, nugget size may be a function of the depth of the pool 30. Increasing the depth, for example, by increasing the flow of aluminum from the furnace 12 to the trough 20, will result in increasing the rotational angle of the cylinder 22 during which there is outflow of aluminum through holes 34 into the mold cavities 42. This control, though, should take into consideration the desire to assure all aluminum flows into a respective mold cavity 42 and does drip, pour or spill on the mold or elsewhere not in the mold cavity. Thus, there ordinarily would be an upper limit for pool depth.

Also, if desired, the size of holes 34 and, if desired, the number of holes used to fill a single mold cavity 42 may be selected to provide a desired mold fill rate or amount.

Although the invention has been shown and described with respect to certain preferred embodiments, it is obvious that equivalents and modifications will occur to others skilled in the art upon the reading and understanding of the specification. For example, although the invention has been described with respect to specific numbers of rows of cavities, holes, etc., it will be appreciated that other numbers could be used equally as well. The present invention includes all such equivalents and modifications, and is limited only by the scope of the following claims.

What is claimed is:

1. An apparatus for continuous casting of molded items, comprising:

a cylinder having a rotational axis, and a generally cylindrical wall surrounding a holding area therein, the cylindrical wall including a plurality of holes through which a material in the holding area can flow out of the cylinder;

a driving mechanism which fully rotates the cylinder about the axis; and a plurality of molds each having a plurality of cavities, the molds being transported in series beneath the cylinder as the cylinder rotates fully about the axis;

wherein as the plurality of cavities pass by the cylinder the material in the holding area pours into each of the plurality of cavities from a respective one of the plurality of holes.

2. The apparatus of claim 1, wherein the plurality of holes are spaced around the circumference of the cylindrical wall at a distance effectively equal to a distance between consecutive cavities in the series.

3. The apparatus of claim 1, wherein the plurality of holes are arranged in rows of holes parallel to the rotational axis of the cylinder, the rows being formed around the circumference of the cylinder, and the plurality of cavities are arranged in rows of cavities with a spacing between rows of cavities corresponding to a spacing between rows of holes.

4. The apparatus of claim 1, further comprising means for supplying additional material to the holding area while the cylinder rotates.

5. The apparatus of claim 4, wherein the means for supplying includes means for controlling the rate at which the additional material is supplied to the holding area.

6. The apparatus of claim 4, wherein the means for supplying controls a level of the material in the holding area.

7. The apparatus of claim 4, wherein the means for supplying comprises means for controlling gravitational flow of the additional material to the holding area.

8. The apparatus of claim 7, wherein the means for controlling comprises a movable trough which selectively directs the additional material to the holding area or to a reservoir.

9. The apparatus of claim 4, wherein the means for supplying comprises a variable speed pump.

10. The apparatus of claim 1, wherein a rotational speed of the cylinder is synchronized with a speed at which the cavities are transported past the rotating cylinder.

11. The apparatus of claim 1, wherein the plurality of cavities are transported by way of an endless conveyor.

12. The apparatus of claim 11, wherein the rotating cylinder and the conveyor are driven by a common driver.

13. The apparatus of claim 1, further comprising means for heating the cylinder.

14. The apparatus of claim 1, further comprising means for creating an inert atmosphere within the cylinder to prevent oxidation of the material.

15. The apparatus of claim 1, wherein the material includes molten metal.

16. The apparatus of claim 15, wherein the material includes molten aluminum.

17. An apparatus for continuous casting of metal shapes, comprising:

a conveyor line;

a rotating cylinder above the conveyor line, the cylinder having a generally cylindrical wall with a plurality of pouring holes therein and the pouring holes being arranged in rows around the circumference of the cylinder;

a driving mechanism which fully rotates the cylinder synchronized with a speed of the conveyor line; and a plurality of molds on the conveyor line, each mold having at least one row of cavities equal corresponding in number to the number of pouring holes in a row on the cylinder;

wherein material within the cylinder pours through the pouring holes at the bottom of the cylinder into the cavities as the cavities pass beneath the cylinder.

18. The apparatus of claim 17, wherein the spacing between the rows of holes on the cylindrical wall is substantially equal to the spacing between rows of cavities on the conveyor line.

19. The apparatus of claim 17, wherein the material is molten aluminum and the apparatus further comprises at least one gas burner placed adjacent to the rotating cylinder to keep the cylinder body at an elevated temperature and to keep an inert atmosphere within the cylinder to prevent oxidation of aluminum.

20. The apparatus of claim 17, further including a synchronized system to operate the rotating cylinder at a linear speed equal to the conveyor speed.

21. A method for continuously casting molded items, comprising:

supplying a material to a cylinder having a rotational axis, and a generally cylindrical wall surrounding a holding area therein, the cylindrical wall including a plurality of holes through which the material in the holding area can flow out of the cylinder;

rotating the cylinder fully about the axis; and transporting in series a plurality of molds each having a plurality of cavities beneath the cylinder as the cylinder rotates such that as the plurality of cavities pass by the rotating cylinder the material in the holding area pours into each of the plurality of cavities from a respective one of the plurality of holes.

22. The method of claim 21, further comprising the step of controllably providing additional material to the holding area and controlling the amount of material in the holding area in order to control the amount of material which is poured into each cavity.

23. The method of claim 21, further comprising the step of controlling the speed of rotation of the cylinder and speed of the cavities passing by the cylinder in order to adjust the amount of material which is poured into each cavity.

24. The method of claim 21, further comprising the step of elevating the temperature of the cylinder and keeping an inert atmosphere within the cylinder to prevent oxidation of the material in the cylinder.

* * * * *